US012448791B2

(12) United States Patent
Ahonen

(10) Patent No.: US 12,448,791 B2
(45) Date of Patent: Oct. 21, 2025

(54) TOOL FOR THE MECHANICAL TREATMENT OF A CONCRETE FLOOR

(71) Applicant: CONCRIA OY, Ylojarvi (FI)

(72) Inventor: Mika Ahonen, Kyroskoski (FI)

(73) Assignee: CONCRIA OY, Ylojarvi (FI)

( * ) Notice: Subject to any disclaimer, the term of this patent is extended or adjusted under 35 U.S.C. 154(b) by 707 days.

(21) Appl. No.: 17/754,070

(22) PCT Filed: Sep. 22, 2020

(86) PCT No.: PCT/FI2020/050609

§ 371 (c)(1),
(2) Date: Mar. 23, 2022

(87) PCT Pub. No.: WO2021/058862

PCT Pub. Date: Apr. 1, 2021

(65) Prior Publication Data

US 2022/0364375 A1 Nov. 17, 2022

(30) Foreign Application Priority Data

Sep. 23, 2019 (FI) ..... 20195794

(51) Int. Cl.
*E04F 21/24* (2006.01)

(52) U.S. Cl.
CPC ..... *E04F 21/247* (2013.01); *E04F 21/248* (2013.01)

(58) Field of Classification Search
CPC ..... E04F 21/245; E04F 21/247; E04F 21/248
See application file for complete search history.

(56) References Cited

U.S. PATENT DOCUMENTS 2,641,169 A * 6/1953 Ytterberg ..... E04G 21/066 404/113
2,662,454 A 12/1953 Marvin
(Continued)

FOREIGN PATENT DOCUMENTS

EP 0561610 A1 9/1993
WO 2017053737 A1 3/2017

OTHER PUBLICATIONS

International Search Report and Written Opinion in corresponding International Application PCT/FI2020/050609 mailed Dec. 8, 2020 (10 pages).

*Primary Examiner* — Gary S Hartmann
(74) *Attorney, Agent, or Firm* — Jeffri A. Kaminski; Venable LLP

(57) ABSTRACT

A tool for the mechanical treatment of a concrete floor, such as for power trowel floating and finishing with blades, for conducting the treatment with a hand-operated, walk-behind or ride-on actuator, such as e.g. with a concrete power trowel, a floor treating apparatus, or the like. The actuator includes one or more operating heads, which include several, such as four, attachment arms perpendicular to each other, for treating a concrete floor with tools coupled in a removable manner into the engagement with each attachment arm. A tool is intended for use in engagement with a trowel floating blade coupled to an attachment arm of the actuator's operating head, whereby the tool with a substantially flat and elongated body includes first and second elements for its coupling and locking on a quick coupling principle for im-movable engagement with the trowel floating blade.

9 Claims, 7 Drawing Sheets

(56) References Cited

U.S. PATENT DOCUMENTS 3,296,946 A * 1/1967 Cagno ..... E04F 21/245 404/112
3,331,290 A * 7/1967 Harding, Jr. ..... E04F 21/248 404/112
3,464,166 A * 9/1969 Bouvier ..... B24D 13/14 65/61
3,683,761 A * 8/1972 Babic ..... E04F 21/245 404/112
4,388,017 A * 6/1983 Morrison ..... E04F 21/245 404/112
4,848,959 A * 7/1989 Morrison ..... E04F 21/245 404/112
4,859,115 A * 8/1989 Morrison ..... E04F 21/245 404/112
5,567,503 A * 10/1996 Sexton ..... B24D 3/30 428/323
6,058,922 A * 5/2000 Sexton ..... B24B 7/186 451/353
6,536,989 B2 * 3/2003 Rijkers ..... E04F 21/247 404/112
7,059,801 B2 6/2006 Snyder et al.
7,775,741 B2 8/2010 Copoulos
10,092,159 B2 * 10/2018 Tchakarov ..... B24B 7/22
11,446,808 B1 * 9/2022 Alemayehu ..... E04F 21/06
11,891,821 B2 * 2/2024 Kipp, Jr. ..... E04F 21/245
2005/0141962 A1 6/2005 Snyder et al.
2005/0254896 A1 11/2005 Ewer et al.
2007/0292207 A1 12/2007 Reed et al.
2009/0028643 A1 1/2009 Snyder et al.
2009/0190999 A1 7/2009 Copoulos
2011/0167626 A1 7/2011 Ye
2014/0323021 A1 10/2014 Blick
2016/0136772 A1 * 5/2016 Littlefield ..... B24B 7/186 451/41
2019/0211517 A1 7/2019 Howle et al.
2020/0130135 A1 * 4/2020 Craft ..... B24B 41/047
2022/0307275 A1 * 9/2022 Ahonen ..... E04F 21/245
2023/0117193 A1 * 4/2023 Howle ..... B24B 7/186 451/350

* cited by examiner

TOOL FOR THE MECHANICAL TREATMENT OF A CONCRETE FLOOR

CROSS-REFERENCE TO RELATED APPLICATIONS

This application is a U.S. National Stage application of PCT/F12020/050609, filed Sep. 22, 2020 and published on Apr. 1, 2021 as WO 2021/058862, which claims the benefit of Finnish Patent Application No. 20195794 filed Sep. 23, 2019, all of which are hereby incorporated by reference in their entireties.

FIELD OF THE INVENTION

The invention relates to a tool as presented in the preamble of the independent claim directed thereto for the treatment of a concrete floor surface, such as for power trowel floating and finishing with blades, by conducting the work with e.g. a hand-operated, walk-behind or ride-on actuator.

BACKGROUND OF THE INVENTION

A common practice in the foregoing purpose is to employ a concrete power trowel of e.g. the walk-behind type shown in FIG. 1*a* or the ride-on type shown in FIG. 1*b*, or a floor treating machine, i.e. a so-called cleaning machine, of the type shown in FIG. 1*c*.

The operating head, i.e. a so-called rotor, of such an actuator consists typically of four attachment arms perpendicular to each other and fitted with concrete trowel elements used each time in the power trowel floating of e.g. a concrete floor.

In the power trowel floating of e.g. a concrete floor to be prepared, the employed concrete trowel elements connectable to the rotor of an actuator conventionally comprise a one-piece circular trowel pan or trowel blades fastened to its attachment arms.

Especially when using concrete trowel elements made of metal, a problem appearing in the power trowel floating of e.g. concrete, epoxy and dry shake coated floors has been discoloration of the floor surface, the cause of which has been established to be friction-induced heating of the metallic trowel pan. Therefore, there are currently in service plastic trowel pans, the use of which enables discoloration of the floor surface to be avoided.

For this reason, there are currently in service e.g. plastic circular trowel pans provided with fixed attachment arrangements, whereby attachment brackets, included therein and to be secured to the rotor of an actuator, are fastened to the trowel pan typically by plastic welding, which is why, first of all, manufacturing of the discussed trowel pans is uneconomical and, second of all, transporting thereof is inconvenient and space-consuming because of the fixed brackets prevent stacking the trowel pans firmly on top of each other. In addition, trowel pans of this type are only commercially available in a specific diameter (900 mm).

In the above purpose there are also currently in service consistently flat circular trowel pans of plastic, which are fastened with screws to a metallic trowel blade connected to the rotor of an actuator. A problem in this type of solution is first that, due to wearing of the trowel pan, the fastening screws are able to make contact with a presently trowel floated floor surface with resulting marks thereon. On the other hand, the replacement of trowel pans is in practice highly laborious or so-called nondestructively impossible due to the wear of screw heads or e.g. the concrete cured thereon.

On the other hand, referring in this context e.g. to patent publication U.S. Pat. No. 7,059,801, there are also currently in service elongated, plastic-constructed, metal-reinforced trowel pans, which are fastened with screws to trowel blades connected to the actuator's rotor, the trowel pans being provided with a mounting portion, thus avoiding the situation that, as a result of the trowel pan wearing down, the fastening screws would come into contact with a presently trowel floated floor surface.

The replacement of such trowel pans is in practice highly laborious or so-called nondestructively impossible due to the wear of screw heads or e.g. the concrete cured thereon. Moreover, in spite of having a metal reinforcement, such a plastic trowel pan is only a single-use product and requires replacement of the trowel pan in its entirety after excessive wearing of its plastic structure.

Furthermore, it is known in so-called diamond grinding of a concrete floor, especially in the case of a circular trowel pan, to employ compressible/porous washing, polishing or waxing discs, which are fastened with a Velcro attachment to its trowel floating surface and along whose periphery are mounted diamond pads for grinding the concrete floor surface. This requires a very careful cleaning of the trowel pan prior to the attachment of Velcro tapes thereto, as well as cleanliness of the Velcro surfaces such that the disc with diamond pads remains reliably attached to the trowel pan.

On the other hand, e.g. the U.S. Pat. No. 7,775,741 discloses a method and apparatus for surface finishing cured concrete with a concrete power trowel by using diamond pads, whereby the diamond pads, included e.g. in individual attachment seats of circular cross-section, are adapted to be adjusted in a spring-loaded manner to a tilted position matching the concrete surface to be abraded. The attachment seats are fixedly fastened by welding to the bottom of a power trowel's trowel pan or to rigid metal strips welded thereto. The spring loading arrangements enabling a tiling motion of diamond pads in the attachment seats comprise three plungers, which are capable of being fitted by screw adjustment inside the attachment seat and whose points, pressing against a metal plate glued to the bottom of the diamond pad, will be able to depress in a spring-loaded manner into the plunger so as to enable tilting of the diamond pad.

In this solution, it is also possible to connect the diamond pads alternatively with a Velcro attachment to recesses present on the trowel pan's trowel floating surface or to use, as a trowel element, elongated plastic sheets, which can be fastened by screw attachment directly to the attachment arms of a concrete power trowel's rotor and which are provided with integral abrading surfaces, such as with a diamond dust coating.

A drawback with the spring loading arrangement used in the aforementioned solution is that the attachment seats are complicated in construction, laborious to assemble, and inconvenient in terms of installation and maintenance. When coupled to a trowel pan by using attachment seats, the diamond pads will be placed at quite a distance from the trowel pan, thereby increasing the risk of breakage for diamond pads. In addition, as a result of dirt accumulating in the attachment seats, as well as along with the wearing and fatiguing of spring loading arrangements, the diamond pads are not able in prolonged service to remain consistently in parallel relationship with the presently abraded floor surface, which necessitates repair or replacement of the plungers so as not to allow uneven wear of the diamond pads.

On the other hand, a drawback with a trowel tool connectable directly to the attachment arms of an actuator's rotor is the laboriousness involved in its installation and removal, which is why the integral abrading surface of a plastic trowel tool does not in practice enable a sufficiently long-term operation without replacing the trowel tool.

An objective of the present working tool, developed for the treatment of a concrete floor, is to provide a decisive improvement over the above-described problems and to thereby raise essentially the available prior art. In order to attain this objective, the working tool according to the invention is principally characterized by what is presented in the characterizing clause of the independent claim directed thereto.

SUMMARY OF THE INVENTION

Some of the most important benefits gained by a tool of the invention should noted to include the simplicity and effectiveness of its construction and assembly, as well as its use, first by virtue of the tool being installable to and removable from a trowel blade without utensils, which enables a rapid replacement of just the trowel pans that are susceptible to wearing. This enables highly effective continuous operation without detrimental disruptions caused by a replacement of the working tool; e.g. "finishing with blades" has a certain time frame during which the concrete floor must be treated.

When using traditional removable trowel floating elements, should it be necessary to replace one or more trowel floating elements of the actuator in the middle of operation, it is quite often that the element/elements cannot be replaced quickly enough as the fastening screws are e.g. "walled up" with concrete. In addition, the concrete surface cures very rapidly in windy and warm conditions, reducing further the time available for "finishing with blades". The worn-out trowel floating elements, on the other hand, cause unwanted impressions on concrete surface.

One benefit offered by a working tool of the invention is also the possibility of being used with equal effectiveness in connection with both a new and old trowel floating blade. In addition, it is possible to manufacture in a very simple manner from any sufficiently stiff material, such as various types of plastic, a metal, i.e. e.g. stainless steel or aluminum, carbon fiber, wood, ceramic, composite, or the like. In this respect, it is possible that the manufacturing material produced e.g. by processing be modified as necessary by incorporating therein e.g. glass, fiber glass or carbon fiber synthetic diamond, etc. for improving wear resistance. The working tool's shape can be also be readily varied so as to achieve optimal smoothness for a concrete floor finished with blades.

In a further preferred embodiment of the invention, it is possible that the working tool be also provided with elements used for abrading a concrete floor, such as e.g. with a diamond abrading arrangement which comprises one or more diamond discs attachable to the working tool in a removable manner, preferably in a quick coupling principle such as with a Velcro surface arrangement or the like. Hence, moreover, the elements for engaging the working tool with the trowel floating blade is provided preferably in a quick coupling principle by using guide channels, which are included in a substantially flat and elongated body of the working tool on opposite sides thereof, and inside which the opposite side edges of the trowel floating blade are cable of being slid in a longitudinal direction of the working tool and the trowel floating blade, and which further make it possible that the resilience system that enables tilting motions of the working tool be positioned between the trowel floating blade and the working tool. In this context, the resilience system comprises e.g. one or more springs or a washer fabricated from an elastic material, e.g. "washing pad" material.

Other preferred embodiments for a working tool of the invention are presented in the dependent claims directed thereto.

BRIEF DESCRIPTION OF THE DRAWINGS

It is in the subsequent description that the invention will be illustrated in detail while referring to the accompanying drawings, in which.

DETAILED DESCRIPTION OF THE INVENTION

Figure 6A:
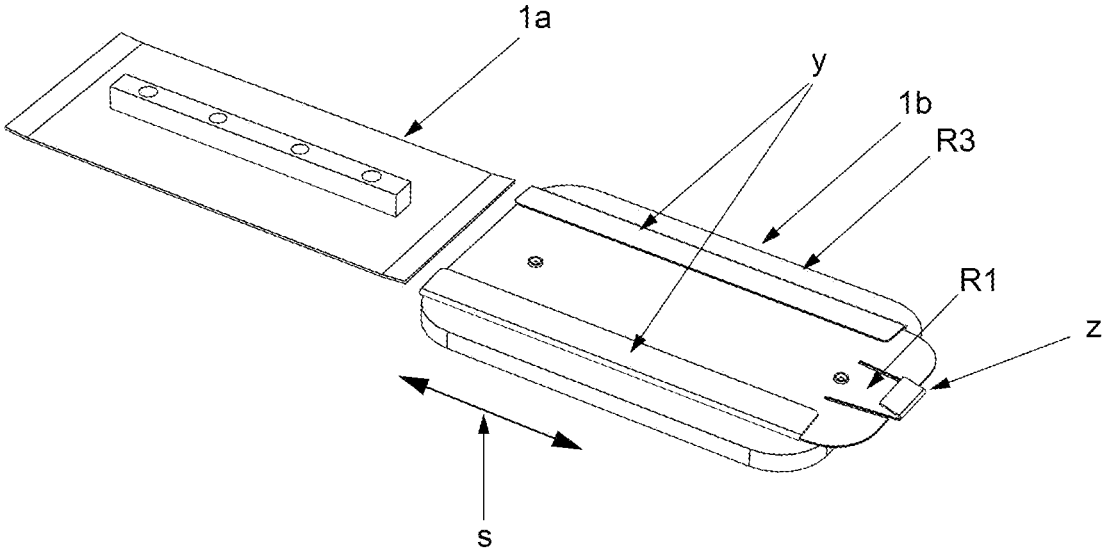
FIGS. 6*a* and 6*b* show, in perspective views, still another alternative embodiment for a tool of the invention as viewed from above in the process of coupling the same to a trowel floating blade and while it is in engagement with the trowel floating blade.
Figure 6B:
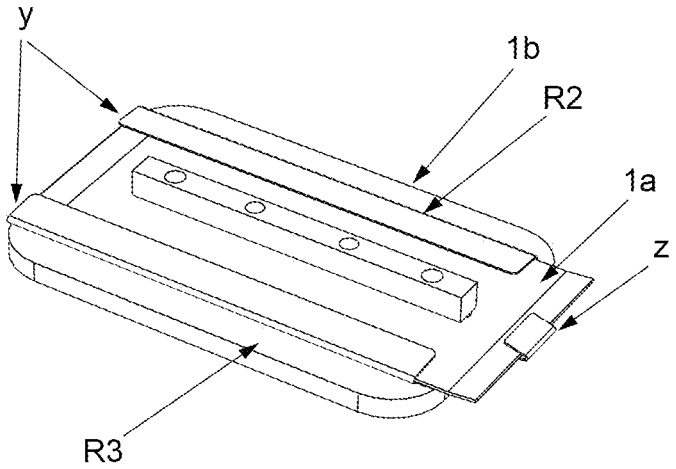
Figure 7A:
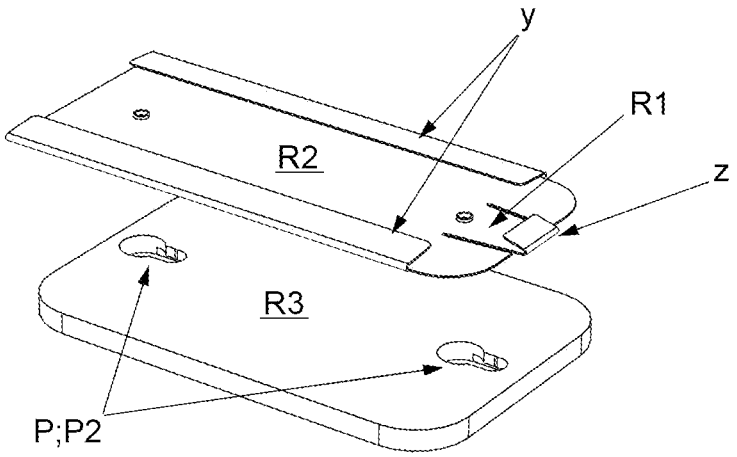
FIGS. 7*a*-7*c* show, in a perspective view, the assembly for a tool of FIGS. 6*a* and 6*b* as viewed from above and from below, and the tool in an assembled condition as viewed from below.
Figure 7B:
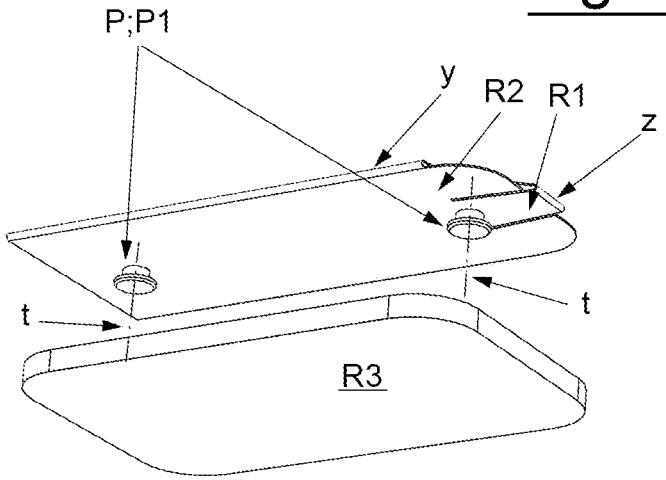
Figure 7C:
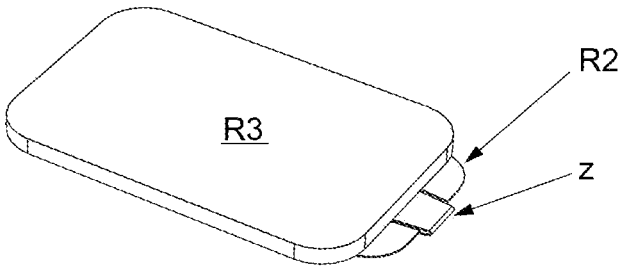

The invention relates to a tool for the mechanical treatment of a concrete floor, such as for power trowel floating and finishing with blades, for conducting the treatment with a hand-operated, walk-behind or ride-on actuator, such as e.g. with a concrete power trowel, a floor treating apparatus, or the like. The actuator includes one or more operating heads A, which consist of several, most typically four, attachment arms A1 perpendicular to each other, for treating a concrete floor with tools coupled in a removable manner into the engagement with each attachment arm. A tool 1*b* is intended for use in engagement with a trowel floating blade 1*a* coupled to an attachment arm A1 of the actuator's operating head A, whereby the tool with a substantially flat and elongated body R includes first and second elements y, z for its coupling and locking on a quick coupling principle for immovable engagement with the trowel floating blade 1*a*. In reference to FIGS. 2*a* and 2*b*, the first elements y are provided by guide channels, which lie on opposite sides of the tool's body R and inside which the trowel floating blade's 1*a* opposite side edges are capable of being slid on a principle appearing from FIGS. 2*a* and 6*a* in a longitudinal direction s of the tool and the trowel floating blade. Respectively, the second elements z are provided by a locking/retaining projection present at an end edge of the tool, which projection, in the process of sliding the tool relative to the trowel floating blade in the longitudinal direction s, attaches on a principle appearing e.g. from FIG. 2*a* against a rear edge of the trowel floating blade.

In a preferred embodiment of the invention, referring e.g. to FIGS. 2*a*, 3*a*, 4*b*, 6*a* and 7*a*, the locking/retaining projection of the second elements z is disposed at the end of a flexible body portion R1 separated with kerfs U from the body R of the tool 1*b* and protruding in the longitudinal direction s from the body's rear edge. Hence, the tool is capable of being fastened to the trowel floating blade 1*a* coupled to the attachment arm A1 of an actuator's rotor A on a principle appearing from e.g. FIG. 2*a* by pushing I the body portion R1 sufficiently downward and by thereafter sliding II the tool 1*b* under the trowel floating blade 1*a*, whereby the parts become locked to each other according to FIG. 2*a* as a locking projection x is able to rise up against the trowel floating blade's rear edge.

Figure 1A:
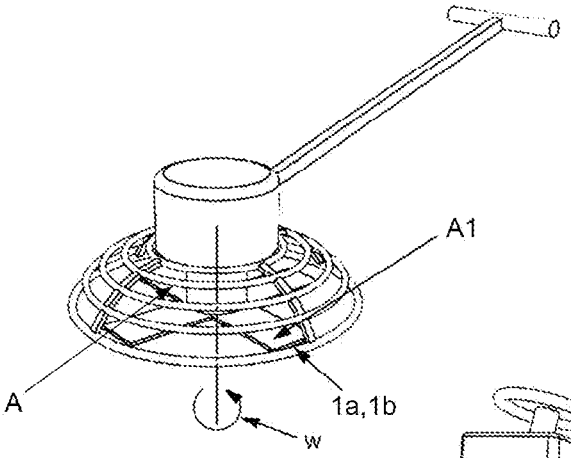
FIG. 1*a* shows one typical walk-behind concrete power trowel with trowel floating blades coupled to its rotor.
Figure 1C:
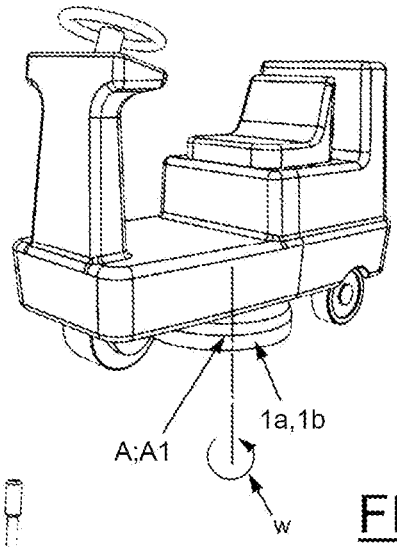
FIG. 1*c* shows further one typical ride-on floor treating apparatus, i.e. a so-called cleaning machine.
Figure 1B:
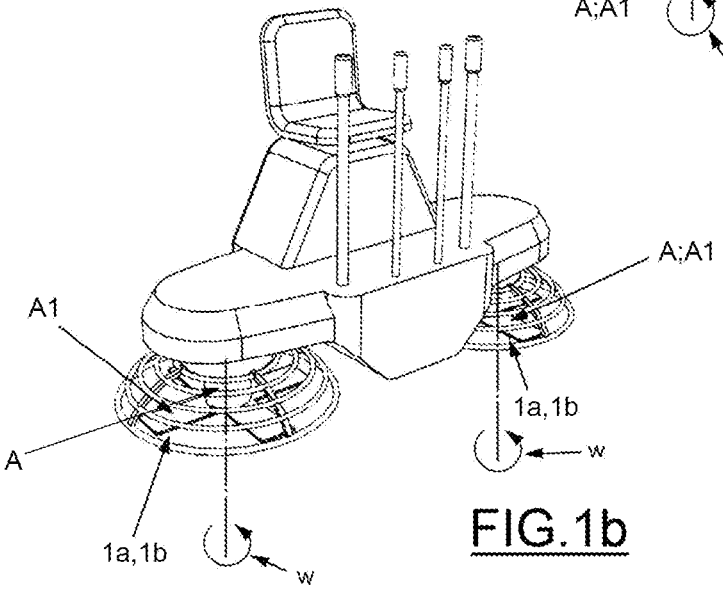
FIG. 1*b* shows further one typical ride-on concrete power trowel with trowel floating blades coupled to its rotor.
Figure 2A:
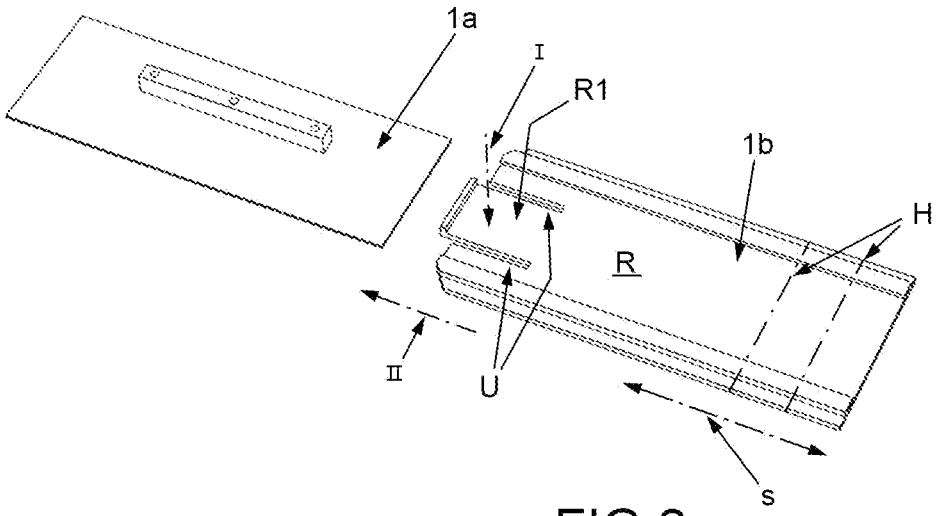
FIGS. 2*a* and 2*b* show perspective top views of the relative movement between a tool of the invention and a trowel floating blade in the process of coupling the same to each other and with the tool in engagement with the trowel floating blade.

In a further preferred embodiment for a tool of the invention, referring particularly to FIG. 2*a*, its body R is provided with means H, such as a marking or notch arrangement, for adapting the tool 1*b* to trowel floating blades 1*a* differing from each other in terms of length, thereby enabling effortless use of the tool also with trowel floating blades of varying lengths.

The tool 1*b* is rigid in construction and fabricated from a substantially thin-walled metal, plastic, composite, ceramic material and/or the like. Referring particularly to plastic embodiments, the tool is fabricated preferably from e.g. ABS, PS, ABS+PC, PETG, PVC, PMMA, ABS+PMMA, PP or APET plastic.

Figure 2B:
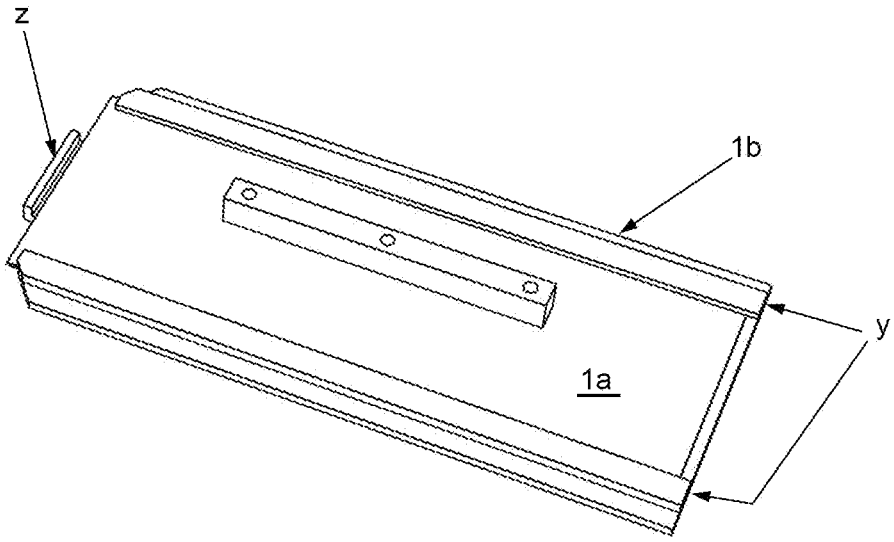

In an embodiment preferred in this respect, referring particularly to FIGS. 2*a* and 2*b*, the tool's 1*b* body R comprises a consolidated unit fabricated from a single, most preferably plastic-based material by processing such as casting or pressing and/or by machining such as milling.

In an embodiment optional with respect to what has been described above, referring particularly to FIGS. 6*a*, 6*b* and 7*a*-7*c*, the tool's 1*b* body R comprises a base member R2 which consists of a rigid, most preferably metallic material, and a trowel pan R3 connected thereto with a quick coupling arrangement P and fabricated most preferably from a plastic-based material. The quick coupling arrangement P is preferably implemented with mutual form locking between a locking pin P1 present on a bottom of the base member R2 and a locking slot P2 present on a top surface of the trowel pan R3, whereby the locking pin P1 works its way through a hole present at an end of the locking slot P2 into an inside of the base member R2 and, as the trowel pan R3 is moved in its longitudinal direction s, becomes locked therein in a vertical direction t.

Figure 3A:
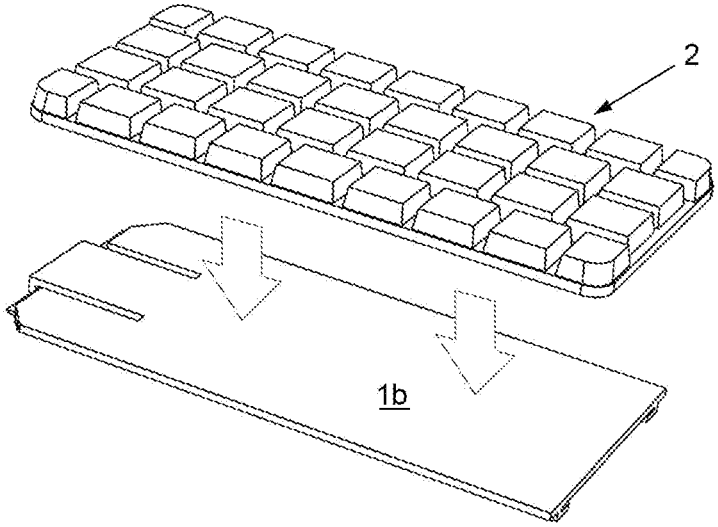
FIGS. 3*a*-3*c* show, in a bottom assembly view, in a top view, and in a bottom view, one preferred embodiment for a tool of the invention together with an integral diamond abrading arrangement engageable/engaged therewith in a removable manner.
Figure 3B:
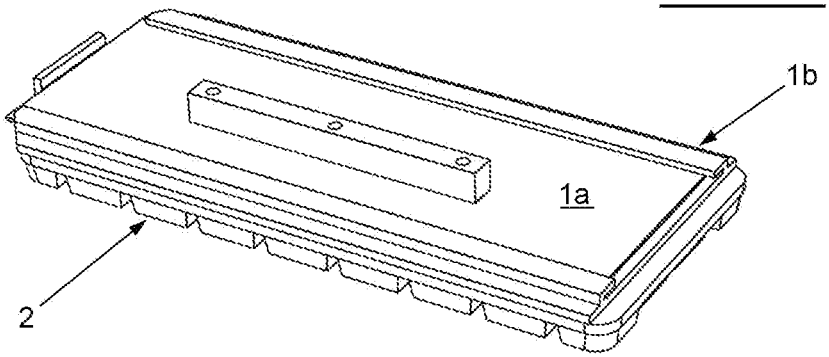
Figure 3C:
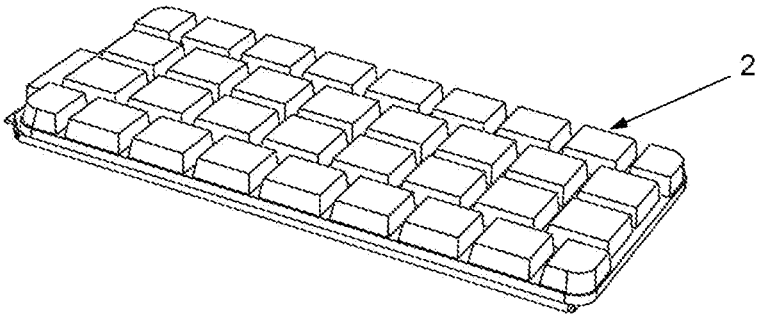

In a further preferred embodiment for a tool of the invention, it comprises elements for abrading a concrete floor, such as a diamond abrading arrangement 2, in which respect FIGS. 3*a*-3*c* illustrate, in a bottom assembly view, in a top view, and in a bottom view, one preferred embodiment for a tool of the invention together with a integral diamond abrading arrangement engageable/engaged therewith in a removable manner.

Figure 4A:
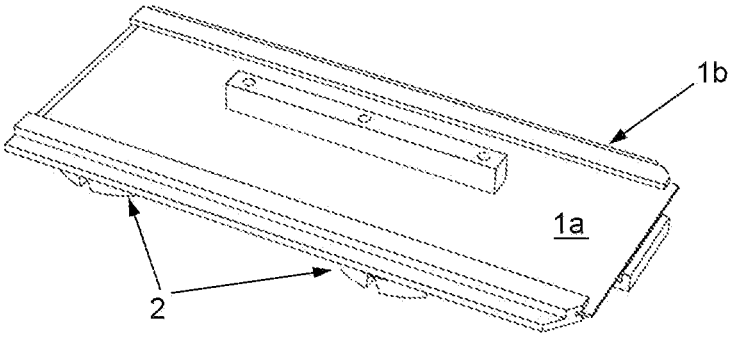
FIGS. 4*a*-4*c* show, in a top view, in a bottom view, and in a bottom assembly view, one preferred embodiment for a tool of the invention together with diamond discs engageable/engaged therewith in a removable manner.
Figure 4B:
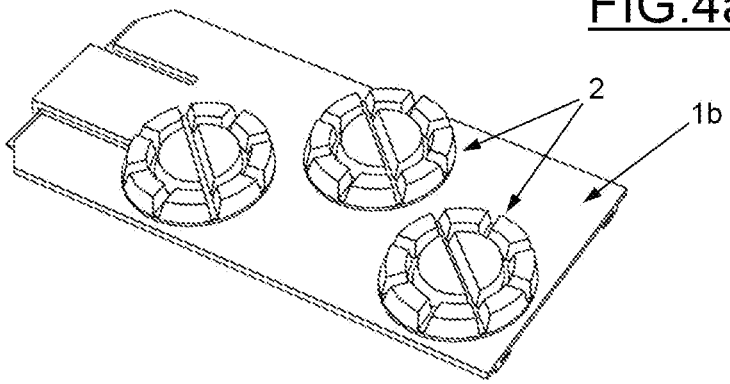
Figure 4C:
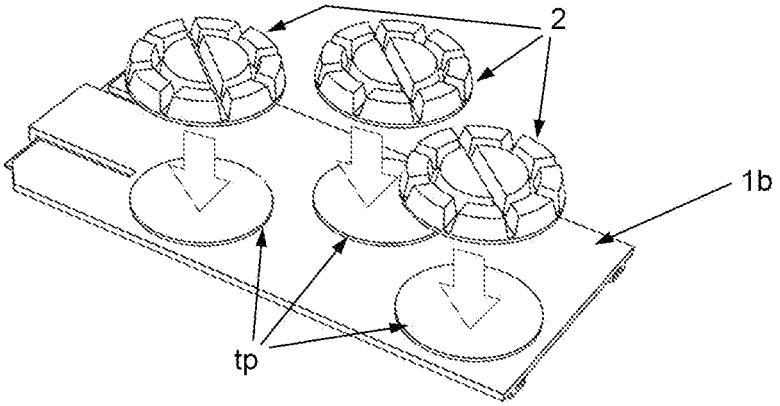

Respectively, the diamond abrading arrangement, included in a tool 1*b* presented as an optional solution in FIGS. 4*a*-4*c*, comprises several diamond pads 2 or the like capable of being fastened thereto in a removable manner, most preferably on a quick coupling principle, such as with a Velcro surface arrangement tp or the like.

Figure 5A:
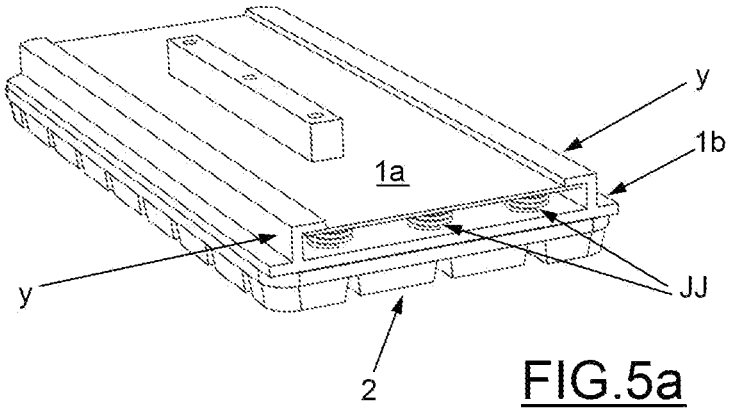
FIGS. 5*a*-5*c* show, in top view, in a top assembly view, and in a side view, one resilience system-equipped embodiment for a tool of the invention together with an integral diamond abrading arrangement engageable/engaged therewith in a removable manner.
Figure 5B:
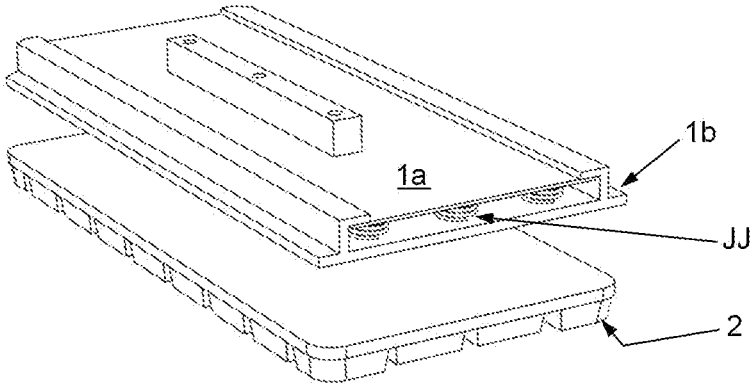
Figure 5C:
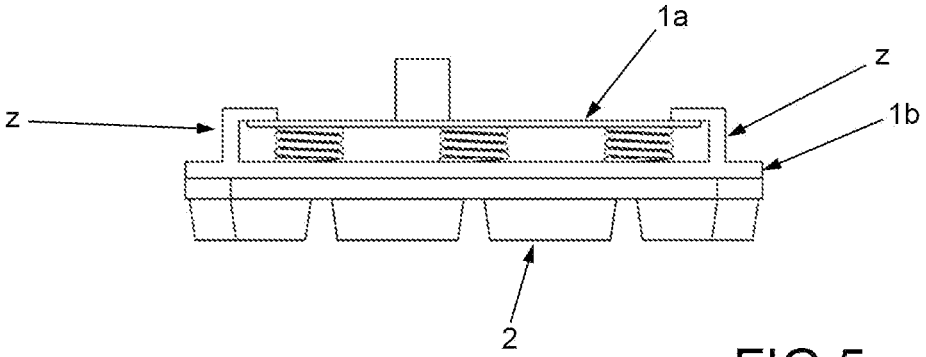

In a further preferred embodiment for an apparatus of the invention, referring particularly to the preferred embodiment presented in FIGS. 5*a*-5*c*, the elements for coupling the tool 1*b* into engagement with the trowel floating blade 1*a* by way of the guide arrangement z comprise, between the trowel floating blade 1*a* and the tool, a resilience system JJ enabling tilting movements of the tool. The resilience system JJ comprises e.g. one or more springs or e.g. a washer disc made of an elastic material (such as e.g. washing pad material).

It obvious that the invention is not limited to embodiments presented or described above, but can be varied within the basic inventive concept in a multitude of ways by using e.g. embodiments depicted in the attached drawings in partial combinations with each other, etc. Likewise, the type of embodiments shown in the attached drawings can be implemented with designs and appearances other than those presented for attaining the same basic objective of the invention. Tools of the invention can be fabricated from a most diverse range of materials by making use of a most diverse range of manufacturing techniques utilizing not only the aforementioned materials but also e.g. biobased, recyclable or biodegradable synthetic or organic materials such as e.g. chemical pulp, etc.

The invention claimed is:

1. A tool for mechanical treatment of a concrete floor, with a power trowel actuator, said actuator comprising one or more operating heads wherein several attachment arms perpendicular to each other are attached, trowel floating blades coupled to the attachment arms and the tool coupled in a removable manner with each of said trowel floating blades, wherein the tool has a substantially flat and elongated body comprising first and second elements for coupling and locking of the tool on a quick coupling principle for immovable engagement with the trowel floating blade, the first elements being provided with guide channels on opposite sides of the tool and wherein the trowel floating blade's opposite side edges are capable of being slid in a longitudinal direction of the tool and the trowel floating blade; and the second elements being provided by a locking/retaining projection present at an end edge of the tool's body, wherein the projection is disposed at an end of a flexible body portion separated with kerfs from the body of the tool and protruding in the longitudinal direction from the body's rear edge, and wherein the projection, in process of sliding the tool relative to the trowel floating blade in the longitudinal direction, attaches against a rear edge of the trowel floating blade to retain the tool on the trowel floating blade during operation.

2. A tool according to claim 1, wherein its body is provided with marking or notch arrangement for adapting the tool to trowel floating blades differing from each other in terms of length.

3. A tool according to claim 1, wherein the tool is rigid in construction and fabricated from a substantially thin-walled metal, plastic, composite and/or ceramic material.

4. A tool according to claim 3, wherein the tool's body comprises a consolidated unit fabricated from a single plastic-based material by casting, pressing and/or by machining.

5. A tool according to claim 3, wherein the tool's body comprises a base member including a rigid material, and a trowel pan connected thereto with a quick coupling arrangement and fabricated from a plastic-based material.

6. A tool according to claim 5, wherein the quick coupling arrangement comprises a locking pin on a bottom of the base member and a locking slot on a top surface of the trowel pan for a mutual form locking between the base member and the trowel pan.

7. A tool according to claim 6, wherein the locking slot comprises a hole at the end of the locking slot, wherein the locking pin is locked in a vertical direction, as the trowel pan is moved in its longitudinal direction.

8. A tool according to claim 1, wherein the first elements comprise a resilience system between the trowel floating blade and the tool to enable tilting movements of the tool.

9. A tool according to claim 8, wherein the resilience system comprises one or more springs, or a washer disc made of an elastic material.

* * * * *